United States Patent [19]

Fleming et al.

[11] 4,439,761

[45] Mar. 27, 1984

[54] TERMINAL GENERATION OF DYNAMICALLY REDEFINABLE CHARACTER SETS

[75] Inventors: James R. Fleming, Indianapolis, Ind.; William A. Frezza, North Brunswick; Gerald S. Soloway, Holmdel, both of N.J.

[73] Assignee: Bell Telephone Laboratories, Incorporated, Murray Hill, N.J.

[21] Appl. No.: 265,338

[22] Filed: May 19, 1981

[51] Int. Cl.[3] ..... G09G 1/16

[52] U.S. Cl. ..... 340/735; 340/790; 340/799; 340/747; 340/748; 358/147

[58] Field of Search ..... 340/706, 747, 748, 790, 340/735; 358/147; 178/30

[56] References Cited

U.S. PATENT DOCUMENTS

| | | | |
|---|---|---|---|
| 4,031,519 | 6/1977 | Findley | 178/30 X |
| 4,041,482 | 8/1977 | Freudeberg et al. | 178/30 X |
| 4,125,829 | 11/1978 | Kayashima | 178/30 X |

OTHER PUBLICATIONS

H. G. Bown et al., Comparative Terminal Realizations with Alpha-Geometric Coding, IEEE Trans. on Consumer Electronics, vol. CE-26, No. 3, pp. 605-614, Aug. 1980.

*Primary Examiner*—David L. Trafton
*Attorney, Agent, or Firm*—David H. Tannenbaum

[57] ABSTRACT

A graphic display terminal is arranged to receive from a sending source drawing instructions containing the description of a display character. The terminal, under control independent from the sending source, interprets each received drawing instruction into a particular picture description bit pattern tailored to the characteristics of the terminal display device. The interpreted bits are then stored in a graphic repertory for subsequent retrievel under control of code received from the sending source. In this manner dynamically redefinable character sets may be created and used without regard to a particular terminal implementation.

17 Claims, 9 Drawing Figures

FIG. 4

| | | | | | | | | | | | |
|---|---|---|---|---|---|---|---|---|---|---|---|
| | | | | $b_7$ | 0 | 0 | 0 | 0 | 1 | 1 | 1 | 1 |
| | | | | $b_6$ | 0 | 0 | 1 | 1 | 0 | 0 | 1 | 1 |
| | | | | $b_5$ | 0 | 1 | 0 | 1 | 0 | 1 | 0 | 1 |
| $b_4$ | $b_3$ | $b_2$ | $b_1$ | COLUMN / ROW | 0 | 1 | 2 | 3 | 4 | 5 | 6 | 7 |
| 0 | 0 | 0 | 0 | 0 | CONTROL SET | | GRAPHICS SET | | | | | |
| 0 | 0 | 0 | 1 | 1 | | | | | | | | |
| 0 | 0 | 1 | 0 | 2 | | | | | | | | |
| 0 | 0 | 1 | 1 | 3 | | | | | | | | |
| 0 | 1 | 0 | 0 | 4 | | | | | | | | |
| 0 | 1 | 0 | 1 | 5 | | | | | | | | |
| 0 | 1 | 1 | 0 | 6 | | | | | | | | |
| 0 | 1 | 1 | 1 | 7 | | | | | | | | |
| 1 | 0 | 0 | 0 | 8 | | | | | | | | |
| 1 | 0 | 0 | 1 | 9 | | | | | | | | |
| 1 | 0 | 1 | 0 | 10 | | | | | | | | |
| 1 | 0 | 1 | 1 | 11 | | | | | | | | |
| 1 | 1 | 0 | 0 | 12 | | | | | | | | |
| 1 | 1 | 0 | 1 | 13 | | | | | | | | |
| 1 | 1 | 1 | 0 | 14 | | | | | | | | |
| 1 | 1 | 1 | 1 | 15 | | | | | | | | |

FIG. 5

| COLUMN / ROW | 0 | 1 | 2 | 3 | 4 | 5 | 6 | 7 |
|---|---|---|---|---|---|---|---|---|
| 0 | | | CONTROL | RECT | NUMERIC DATA | | | |
| 1 | | | | | | | | |
| 2 | | | | | | | | |
| 3 | | | | | | | | |
| 4 | | | POINT | POLY | | | | |
| 5 | | | | | | | | |
| 6 | | | | | | | | |
| 7 | | | | | | | | |
| 8 | | | LINE | INCR | | | | |
| 9 | | | | | | | | |
| 10 | | | | | | | | |
| 11 | | | | | | | | |
| 12 | | | ARC | CONTROL | | | | |
| 13 | | | | | | | | |
| 14 | | | | | | | | |
| 15 | | | | | | | | |

TERMINAL GENERATION OF DYNAMICALLY REDEFINABLE CHARACTER SETS

BACKGROUND OF THE INVENTION

1. Field of the Invention

This invention relates to a video display system for the presentation of graphics and more particularly to a system for expanding the graphic capabilities of a terminal in an independent manner.

2. Discussion of the Context of the Invention

Computer-based information systems have now evolved to the stage where it is both desirable and feasible to allow the public access to the wealth of information stored in private or public data bases using commonly available display devices and communicating via existing channels. "Viewdata" or "videotex" are generic terms which have been used to describe systems enabling two-way, interactive communication between the user and the data base, generally communicating via telephone lines and using an ordinary but specially adapted television set for display of pictorial information. "Teletext" is another generic term used to describe one-way communication from the data base to the user, with transmission being accomplished in portions of the broadcast T.V. spectrum, and display again being on a specially adapted T.V. Both system types must have a large range of flexibility, since a number of alternatives exist with respect to various system components. For example, although a television set may be a preferred display device for home use, different terminals may access the data base in an office environment, such as bi-level (plasma) displays, and other special purpose CRTs. Additionally, other communication channels, such as dedicated coaxial, twisted pair cable, or satellite or land-based radio may interconnect the users who input or output information from the data base, and each type of channel has its own requirements and limitations.

In view of the fact that different types of equipment and facilities must interact to achieve satisfactory overall results, several attempts have been made to standardize the manner in which information (primarily pictorial as opposed to text) is encoded and decoded. The success of these systems, which include one described by the Communications Research Center of the Canadian Department of Communications, in CRC Technical Note No. 699-E published November 1979 in Ottawa, Canada, must be measured against several parameters. First, the procedure used to encode the pictorial information must make reasonably efficient use of the bandwidth available in the communication channel and the processing capability of the microprocessor usually located in the user's terminal. Second, the users of the system must, during both encoding and display operations, have a high degree of control and flexibility in specifying how the information will be processed. Finally, the techniques used must recognize that different equipment—particularly displays—will be used, some having non-standard resolution and other capabilities, and that all must operate satisfactorily using the same encoding/decoding strategy.

DISCUSSION OF THE PROBLEM

In an attempt to standardize graphic display systems, there is presented the problem of graphic expansion so that a large variety of shapes can be displayed on the receiving terminal. These problems center around the desire to have the transmitted data independent of the actual terminal so that any one of a number of terminals may be used interchangeably without regard to the resolution capability of the receiving terminal. In an attempt to achieve this result, the transmitted graphical data must either be tailored to fit the receiving terminal's resolution or must be generated to fit a so-called "standard" terminal.

The tailoring solution is not acceptable for communication among a number of different users having different terminals since it is not always possible to know in advance the terminal type of the receiving station. Such a solution is also not practical because terminals may change from time to time thereby requiring the reworking of all previously generated code. As discussed above, the standardization technique is not acceptable for general usage.

By way of example of the existing problem, let us consider a display having 200 picture elements (PELS) arranged into ten rows, each row having twenty elements. A PEL is the smallest displayable unit on a given display device. If it is desired to draw a line on the screen, the input code would specify the location of each PEL which should be lighted on the display. Thus, if the line were to be drawn across the top of the display, the address locations of the twenty PELs forming that row would be transmitted to the screen from the sending source. The screen would then display the line as a series of lighted PELs at the specified location. In this situation the received input code would contain the address locations for twenty light PELs.

Now assume that it is desired to use a terminal with more resolution, such as for example, a display having fifteen rows, each row having thirty PELs. With such a display (and assuming no change in the source transmission) the input from the sending source would only have instructions for twenty PELs in the top row instead of for the actual thirty PELs. Thus, the resulting displayed line would either be skewed left on the display or some form of compensating algorithm would be needed to readjust the incoming code so that all thirty top row PELs would be used.

A modified but still undesired technique is known for sending the PEL patterns which reduces the amount of code necessary but does not solve the terminal dependence problem. This technique uses dynamically redefinable character sets (DRCS) transmitted from the sending source at the beginning of each session or at the beginning of any phase of interaction within a session. The received character sets contain the actual PEL patterns that will be used in the message which is to follow. The received PEL patterns are then stored in designated repertory locations at the terminal, and once stored, the sending source need only specify the location of the stored PEL pattern in order to have the associated graphic character displayed on the screen.

Thus, in the case of a circle, the sending source would specify the address location of the priorly stored circle within the prestored PEL set. The sending source would also specify the location where the circle should be presented on the display. The terminal, in response to the specified storage locations, would then extract the prestored graphic from the file and map it to the display.

This arrangement can be used for foreign alphabets which initially might consist of a series of lines which then would be reduced at the sending end to a coded series of address locations of lighted PELs within the character area. The coded series of addresses then would be stored at the designated file location in the receiving terminal.

This code expansion technique, while an improvement, suffers from the problem that it is terminal dependent since the actual PEL patterns are developed at the sending end for a so-called standard terminal or generated specifically for the specific end use terminal.

One system for overcoming the terminal dependent problem has been to transmit to the terminal the desired end result and then allow the terminal to establish the resultant graphic. Thus, for the presentation of a circle on the receiving screen, the sending source would generate a generalized command instruction for drawing a circle. The receiving terminal would then translate the received generalized command into a locally acceptable set of PEL patterns corresponding to a circle. The local set of patterns would then be tailored to the resolution of the terminal display. The generated PEL patterns would then be displayed. In this situation, the actual PEL control information is not transmitted from the source, but rather the instructions for the final result are transmitted. This technique requires large transmission times for complex graphics, such as test in foreign languages, where large numbers of instructions are necessary for each character.

SUMMARY OF THE INVENTION

These and other problems are solved by the use of our invention wherein the receiving terminal is arranged to accept code representative of the desired character and to translate that code into a set of display control bit patterns for controlling the picture elements (PELs) of the display, each of the translated bit patterns being tailored for the resolution and other particular characteristics of the display associated with the terminal. The bit patterns, instead of being used immediately to create a graphic image, are used to create a graphic repertory or local data base at the terminal which can subsequently be retrieved under specific address instructions from the sending source. The retrieved bit patterns are mapped to the display in the same manner as are the PEL bits retrieved from the permanently stored data base. The retrieved PEL control code can be selectively scaled by attributes either locally generated or by attributes received from the sending source.

Using our arrangement, the receiving terminal interprets the received graphic command in accordance with any algorithm designated by the terminal user or by the terminal manufacturer. Thus, the graphic display system becomes fully terminal independent while also achieving economy of code transmission and generation. In one embodiment of our invention the terminal interprets the drawing code into actual PEL patterns, and in a second embodiment the incoming drawing code is changed into terminal commands tailored to the display. In both situations the input character can be adjusted under joint control of the source and the terminal. The adjustment may be of size, rotation, background or any other attribute.

BRIEF DESCRIPTION OF THE DRAWINGS

The above-discussed problems, as well as other problems and solutions, will become clearer from a view of the drawings in which

FIG. 4 shows the rows and columns of typical inuse decoding table;

FIG. 5 shows the picture drawing instructions (PDI) table;

GENERAL DESCRIPTION—BACKGROUND

Figure 1:
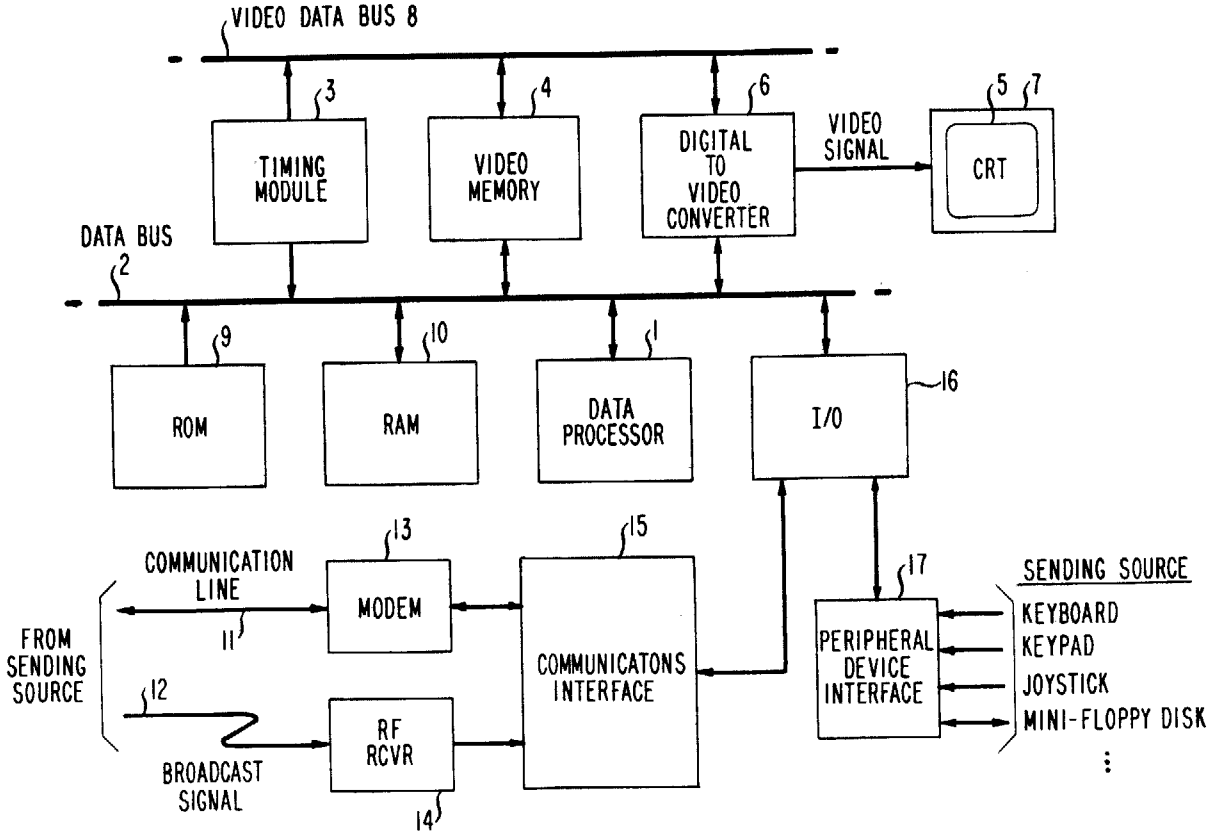
FIG. 1 shows an overall illustration of a typical teletext/videotex terminal.

Referring now to FIG. 1, there is shown a general block diagram of a digital image display system employing the principles of the present invention. The digital image display system comprises a dataprocessor 1 having bidirectional access to data bus 2. Timing module 3 provides the clock signals required for system operation. Timing module 3 also provides timing signals on video data bus 8 for use by video memory 4, and by digital to video converter 6.

Data processor 1 may be a microprocessor comprising program memory, read only memory 9 and scratch pad or random access memory 10. Data processor 1 responds to user input from a keyboard, light pen or other data input devices well known in the art. In its application with a viewdata or teletext terminal, data processor 1 may also respond to input provided from a remote or centralized data base such as one located at a television broadcast station or a provider of viewdata services. This input is received via communication line 11 and modem 13 or as a broadcast signal 12 via RF receiver 14 to communication interface 15. Input-output device 16 operates to control data from communications interface 15 or from peripheral device interface 17.

Data bus 2 is a bidirectional conduit through which data processor 1 controls video memory 4, timing generator 3 and video controller 6. Several bus structures may be adapted for use in the present invention. Whichever specific bus structure is chosen, the bus generally comprises address capability, a data path and control lines which may include interrupt, reset, clock (for synchronous use), wait (for asynchronous use), and bus request lines.

Timing module 3 may provide the timing signals on both the data bus 2 and the video data bus 8 and may comprise a chain of programmable logic circuits, digital dividers and counters for providing required timing signal outputs. These may, of course, be incorporated into data processor 1. For operation of video data bus 8, a number of different timing signals are required. Horizontal and vertical drive signals are provided in accordance with horizontal and field rates respectively. A dot clock signal is provided at the dot frequency (picture element or PEL rate) of the system. An odd/even field signal indicates if the odd or even field is to be displayed in an interlaced system. A composite blanking signal indicates if video is being displayed or if vertical or horizontal retrace is occurring. Also, a group clock signal or other signals may be provided. The group clock signal indicates when to access data for a new group of picture element data from memory. For example, picture element data in video memory having a slow access time may be serially provided in groups of 4, 8 or 16 picture elements. On the other hand, a parallel data transmission scheme is possible, potentially increasing the requirements for leads of video data bus 8.

Digital to video converter 6 accepts digital image information from the video data bus 8, PEL-by-PEL, and converts the digital information, if necessary, to analog form for presentation on video display 7. The video converter may be in modular form and comprises three components: (1) color map memory, (2) digital to analog conversion and sample and hold circuits, if required by video display 7, and (3) a standard composite video encoder (for example, for providing NTSC standard video or red, green, blue RGB outputs) and RF modulator (if necessary, for antenna lead-in access to a television set display 7).

Video display 7 may either be a monitor or a television set or it may be other forms of graphic display known in the art, including a liquid crystal display, an LED display or a plasma panel display.

Definition of Terms

Before progressing further, it may be helpful for the reader to have the following glossary of terms for reference purposes:

attribute—a settable parameter to be applied to subsequent TEXT characters or geometric graphic primitives.

character field—the rectangular display area within which a TEXT character is defined.

code extension—techniques for expanding the absolute character address space of a byte oriented code into a larger virtual address space.

code table—the set of unambiguous rules that define the mapping between received bit combinations and presentation level characters.

designate—to identify a given set from the graphics repertory as either the G0, G1, G2, or G3 set.

display area—the addressable area of the physical display screen onto which the unit screen is mapped.

drawing point—a logical indicator of the screen position at which the next geometric graphic primitive will commence execution. This is not normally marked by a drawing point symbol.

escape sequence—a two or three character code extension command beginning with the ESC character. A three character escape sequence contains an intermediate character (I) and ends with a final character (F), and is used primarily to designate a set from the graphics repertory as one of the four active G sets. Two character escape sequences contain only a final character (F) and are one method by which code sets are invoked into the in-use table (shown in FIG. 3).

final character—the last character of a three character escape sequence that is primarily used to indicate the selected member of the graphics repertory to be designated as one of the four active G sets.

Figure 3:
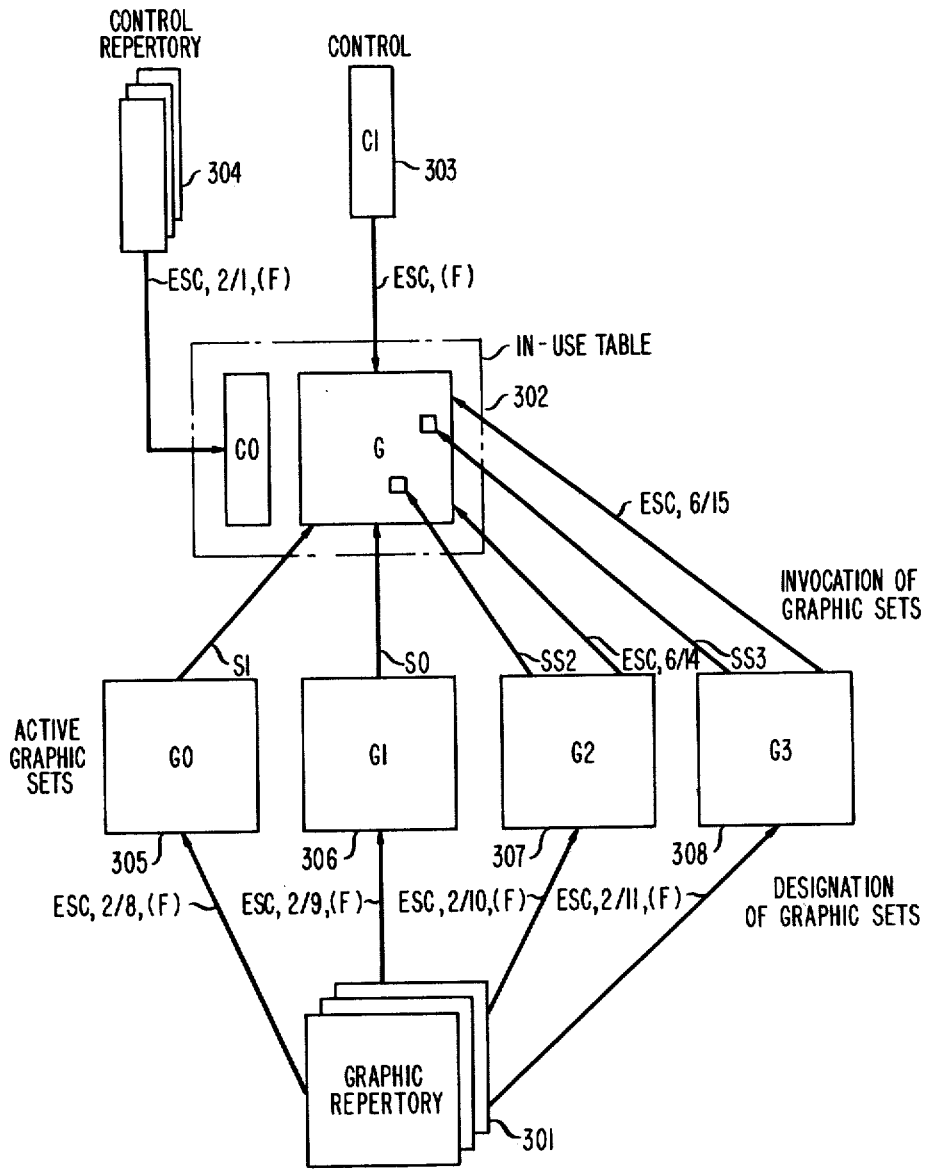
FIG. 3 is a conceptual view of the invocation of graphic sets from a graphic repertory to a memory for a processor.

G set—stands for graphic set. There are four G sets, G0, G1, G2, and G3, each of which comprises 96 character positions arranged in 6 columns by 16 rows.

geometric graphic primitive—a locally stored picture drawing algorithm that can be called via a specified op code and associated operand(s).

graphics repertory—the collection of available graphic sets that are subject to designation as one of the G sets.

in-use—refers to the code sets or attributes that will be used to interpret or be applied to subsequently received commands (shown in FIG. 4).

intermediate character—the second character in a three character escape sequence that is primarily used to indicate whether the G0, G1, G2, or G3 set is to be redesignated.

invoke—to bring one of the four active G sets into the in-use code table (shown in FIG. 3).

mosaic primitive—a rectangular matrix of six elements, each of which may be made up of multiple PELs, which is processed as TEXT but can be used to construct block style graphic images.

op code—a one byte, presentation level character that initiates the execution of a locally stored geometric primitive or control operation. An op code may be followed by one or more operands.

operand—a single or multiple byte string from the numeric data field of the PDI code set that is used to specify control, attribute, or coordinate parameters required by the op code.

PDI—Picture Description Instruction. A PDI is composed of an op code followed by one or more operands and constitutes an executable picture drawing or control command.

PEL—Picture Element. The physical PEL is the smallest displayable unit on a given display device. The "logical" PEL is a geometric construct associated with the drawing point whose size determines the stroke width of graphics primitives.

presentation level—a protocol level responsible for the encoding of text, graphics, and display control information protocol—a set of formats, rules, and procedures governing the exchange of information between peer processes (levels).

relative coordinates—an ordered pair, or triple, of signed numbers between −1 and 1 (non-inclusive) that specify (in two's complement arithmetic) either the new location of the drawing point with respect to the old location of the drawing point, when used within a geometric primitive PDI, or the dimensions of a given field, when used with one of the control commands.

TEXT—pre-defined PEL patterns which, when called, are drawn with a set of pre-selected attributes at positions on the screen indicated by the cursor.

unit screen—the virtual display address space within which all PDIs are executed and TEXT characters are deposited. The dimensions of the unit screen are 0 to 1 in the horizontal (X), vertical (Y), and depth (Z) dimensions. (The latter is only defined in 3-D mode.)

General Description-System Operation Basic Coding Scheme Structure

The coding scheme structure employed is based on the techniques described in the ISO 2022 standard and is very similar to the same technique disclosed in Communications Research Center (CRC) Technical Note No. 699-E published November 1979, which is hereby incorporated by reference herein. The following discussion is a brief description of the information contained in the Canadian document. Those readers wishing an expanded discussion will find it in the Canadian publication, hereinafter called the CRC document. In addition, it must be borne in mind that graphic display systems, such as the Norpak Mark III Telidon terminal or the Advanced Electronic Design terminal number 512, are now commercially available, and our invention can be used in conjunction with any of these terminals by those skilled in the art. Much of the discussion from this point in this description until the Detailed Description, with the exception of those sections discussing DRCS, are provided as illustrative examples of system capability which exists today and are not needed for an understanding of the invention.

Data codes are formatted into 32-character control (C) sets and 96-character graphic (G) sets as shown in FIG. 4. These sets are manipulated, for the purpose of providing a virtual address space larger than the 128 or 256 charcters available in a 7-bit or 8-bit code, via code extension techniques.

Code Extension for 7-Bit Environment

A code in which each data word (byte) consists of 7 information bits allows for the simultaneous representation of up to 128 characters. This 128 character absolute address space can be extended into a much larger virtual address space via the code extension procedures described below.

A 128 character in-use table is defined, as shown in FIG. 4 and representated graphically in FIG. 3 as box 302. Each incoming character is either decoded according to the current contents of this table or is used to change the contents of this table. The table itself (FIG. 4) is organized into eight columns of sixteen rows, with bits 1 through 4 defining the row number and bits 5 through 7 defining the column number. The in-use table always contains, in columns 0 and 1 the control code. Five characters of this control set, escape (ESC or 1/11, i.e., column 1, row 11), shift-in (SI or 0/15), shift-out (S0 or 0/14), single-shift 2 (SS2 or 1/9), and single-shift 3 (SS3 or 1/13), are used to control the contents of the remaining six columns of the in-use table. The manner in which this is accomplished is graphically depicted in FIG. 3.

As shown in FIG. 3, four active graphic sets, the G0, G1, G2, and G3 sets (305–308), are defined and can be dynamically selected from the larger graphics repertory 301 by using three character escape sequences as shown. These sequences take the form ESC, (I), (F) where I is the intermediate character and F is the final character. The intermediate character determines which set is to be changed (re-designated).

The final character determines which set from graphics repertory 301 is to be selected. The F character (not shown) for the ASCII alphanumerics is assigned as 4/2. The three character escape sequence ESC, 2/8, 4/2, therefore, designates the ASCII alphanumerics as the current G0 set.

The SI character is used to invoke the current G0 set into the in-use table where it remains until further control action is taken (i.e., it is invoked in a locking manner). The SO character is used to invoke the current G1 set into the in-use table in a locking manner. The sequence ESC, 6/14 is used to invoke the G2 set into the in-use table in a locking manner. The sequence ESC, 6/15 is used to invoke the G3 set into the in-use table in a locking manner. The single-shift characters, SS2 and SS3, are used to invoke, in a non-locking manner, the G2 or G3 set, respectively, into the in-use table. (The range of the single-shift characters extends only to the next character received, that is, the in-use table automatically reverts to its former state after the character immediately following the single-shift is interpreted.) If any of the G sets are re-designated via a three character escape sequence while it is in the in-use table, the new code interpretations are simultaneously invoked, that is, a locking shift is not required for the change to take effect.

Upon initialization, the ASCII alphanumerics are designated as the G0 set and the G0 set is invoked into the in-use table. The PDI codes are designated as the G1 set, Supplementary Graphics Characters are designated as the G2 set, and Mosaics are designated as the G3 set.

Graphic Sets

This section defines the graphic sets that can be used in conjunction with the code extension schemes described. Each graphic set consists of 96 character positions arranged in six columns by sixteen rows. Any one of these sets can be designated as any one of the four active G sets at any time. In a 7-bit environment these sets, when invoked, would occupy columns 2 through 7 of the in-use table, FIG. 4.

Text

Four graphic sets in graphic repertory are specifically designated as TEXT sets. These are ASCII alphanumerics, Mosaics, Supplementary Graphics Characters, and Dynamically Redefinable Character Sets (DRCS) which is the subject of this invention. In each case, a given character in the set represents a predefined image which, when called, is drawn or mapped with a set of selectable attributes at a position on the screen determined by a controllable text cursor. It is, of course, understood that the local data base memory, or graphic repertory, need not have all of these sets and may consist of only part of one set.

The selectable attributes include size, color, reverse video, underline, and orientation. These attributes are briefly introduced below and are covered in greater detail hereinafter, along with the procedures for their selection. The mapping routine is shown in our concurrently filed copending application, entitled "Pictorial Information Processing Technique," Ser. No. 265,338.

TEXT characters can be specified in a continuous range of sizes. The sizes are defined in terms of the width (dX) and the height (dY) of the character field, with dX and dY representing fractions of the unit screen. The character field maps to a rectangular matrix of PELs within which the TEXT character is defined. The default character size, will produce displays with a nominal screen format of 40 characters horizontal by 29 rows vertical on a standard rectangular CRT.

The coloring attribute provides the capability to either define a foreground and background color for a character or define a foreground color only, with an implied "invisible" background. In the latter case, the character overwrites the existing contents of the display storage medium only at the locations corresponding to the selected PEL pattern. When the reverse video attribute is selected, the PEL pattern is complemented within the defined character field prior to the writing process. Orientation refers to the rotation of the character with respect to the horizontal. Rotations of 0 degrees, 90 degrees, 180 degrees, and 270 degrees can be selected.

ASCII Alphanumerics

Figure 2:
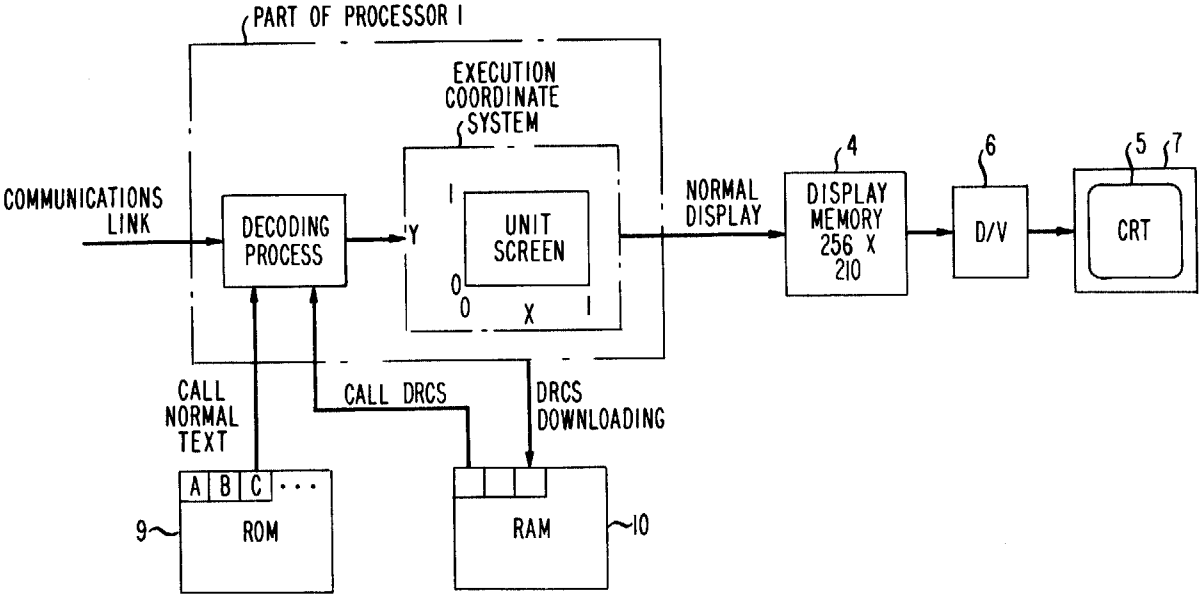
FIG. 2 shows a portion of such a terminal utilized for our invention.

FIG. 2 of the CRC document shows the character assignments for the ASCII alphanumeric set. The particular PEL patterns (font) chosen for the characters are not defined and are constrained only by the specified character field at each size for a given display resolution. Character legibility is not guaranteed at all sizes in all colors at all display resolutions. All display devices, however, must support at least the default character size.

Other character sets, such as Mosaics and supplementary graphic set as described in CCITT Recommendation S.100, "International Information Exchange for Interactive Videotex," Yellow Book, Vol. VII.2, Geneva, 1980, can also be part of the graphic repertory, each being invoked into the in-use table as needed. In this implementation, the mosaic set is assigned the F character, 7/13; and the supplementary graphic set is assigned F character 7/12.

Dynamically Redefinable Character Set (DRCS)

As discussed previously, our invention is directed to the reception of a generalized drawing code from a sending source and then converting that drawing instruction to either a local data base of PEL patterns or to a series of unique stored terminal instructions for subsequent PEL point decoding when necessary. Once the drawing instructions are converted into PEL display codes, these codes can be downloaded into RAM, such as RAM 10 shown in FIG. 2. Thus, unlike the other TEXT sets, whose PEL pattern definitions are permanently stored in the terminal and cannot be altered by the host computer, the Dynamically Redefinable Character Set (DRCS) provides a facility whereby a maximum of 96 custom sending source defined images (arranged in the standard six columns of sixteen rows) can be downloaded into the terminal graphic repertory and utilized as TEXT in an identical manner to the permanently stored ASCII, Supplementary Graphics, and Mosaic sets. At display time, therefore, they are subject to the same TEXT attributes as are the permanently stored grpaphic sets. The manner in which the PEL patterns are actually downloaded will be discussed in the Detailed Description.

The F character designation for the DRCS is 7/11.

Operands

The fixed format operands consist of one or more bytes of numeric data whose length and interpretation depends on the op code with which they are used. The string operands are of indeterminate length, that is, they consist of any number of bytes of numeric data. Their interpretation also depends on the op code with which they are used, but in all cases they are decoded left to right, i.e., b6 to b1. The single-valve operands consist of one, two, three, or four bytes of numeric data, as determined by the DOMAIN command. They are interpreted as unsigned integers (ordinal numbers) composed of the sequence of concatenated bits taken consecutively (high order bit or b6 to low order bit or b1) from the numeric data bytes.

The multi-value operands consist of one, two, three, four, five, six, seven, or eight bytes of numeric data, as determined by the DOMAIN command. These operands are used to specify coordinate information, when used in conjunction with the graphic primitives, or color information, when used in conjunction with the SET COLOR command.

Picture Description Instruction (PDI) Set

The Picture Description Instruction (PDI) set, shown in FIG. 5, comprises six geometric graphic primitives (POINT, LINE, ARC, RECTANGLE, POLYGON, and INCREMENTAL), each of which has four forms; eight control codes (RESET, DOMAIN, TEXT, TEXTURE, SET COLOR, CONTROL STATUS (WAIT), SELECT COLOR, and BLINK); and 64 character positions for numeric data (corresponding to a six bit data field in each information byte.) The PDI set can be fundamentally differentiated from the TEXT graphic sets in that it does not consist of pre-defined images, one per character, but executable drawing functions which produce an image not necessarily restricted to a single character field. The calling syntax, moreover, consists of multiple byte commands, unlike the TEXT sets in which each character produces a single PEL pattern.

A PDI is composed of an op code, which must be either one of the four forms of the six graphic primitives or one of the eight control codes, followed by one or more operands, each of which consists of one or more bytes of numeric data. (The former can always be distinguished from the latter by examining bit 7. If b7 is set to 0, an op code is indicated. If b7 is set to 1, numeric data ((i.e., an operand)) is indicated.) There are four types of operands: fixed format, string, single-value, and multi-value.

Controls

The eight control codes of the PDI set are used primarily to control the attributes and display parameters of both TEXT and graphics as well as to control the length of the single and multi-value operand formats. These codes are individually described below.

DOMAIN

The DOMAIN command is used to control operand parameters as well as the "logical" PEL size. Once set, these parameters do not change until acted upon by either the RESET command, or another DOMAIN command. The DOMAIN op code takes a one byte, fixed format operand, followed by a multi-value operand, whose interpretations are described below.

The fixed format operand is responsible for (1) setting the length of the single value operand, which can be one through four bits long, (2) setting the length of the multi-value operands, which can be one through eight bits long, and (3) setting the dimensionality mode, which can be 2D or 3D.

The multi-value operand specifies the "logical" PEL size to be used in the execution of the PDI drawing commands (i.e., POINT, LINE, ARC, RECT, POLY, and INCR). The "logical" PEL, whose width (dX) and height (dY) are interpreted in the coordinate system defined by the unit screen, is associated with the drawing point, and in effect provides a controllable stroke width capability. (Note that this will not affect the display of TEXT characters.) This is accomplished by defining the drawing operations to affect all of those display PELs that lie under any portion of the "logical" PEL as it is mapped to the display screen. The "logical" PEL, therefore, will always map to at least one and possibly many display PELs. Note that if the width and height of the "logical" PEL are both reduced to 0, the "logical" PEL reduces to the dimensionless drawing point. The geometric alignment of the drawing point within the "logical" PEL is (a) lower left corner if dX and dY are both positive, (b) lower right corner if dX is negative and dY is positive, (c) upper left corner if dX is positive and dY is negative, and (d) upper right corner if dX and dY are both negative. The default "logical" PEL size is $dX=+0, dY=+0$.

TEXT

The TEXT control is used to control parameters related to the attributes of TEXT characters as well as the cursor. These attributes include current character size (dX, dY), rotation, character path, intercharacter spacing, inter-row spacing, cursor style, relationship between the cursor position and drawing point position.

TEXTURE

The TEXTURE command is used to set several texture attributes that are applied to subsequent drawing commands. The line texture attribute applies only to the LINE, RECT (outlined), ARC (outlined), POLY (outlined), and INCR.LINE primitives. The highlight attribute applies to the RECT (filled), ARC (filled), POLY (filled), and INCR.POLY (filled) primitives. The texture pattern attribute and mask size parameters apply to the RECT (filled), ARC (filled), POLY (filled), and INCR.POLY (filled) primitives.

Color Controls

Three different color modes can be selected, the choice of which dictates the precise interpretation of the two color control op codes, SET COLOR and SELECT COLOR. This technique is the subject of our concurrently filed copending patent application titled, "Terminal Independent Color Memory for Digital Image Display System". The color mode can be set to either 0, 1, or 2 via the SELECT COLOR PDI as described below. Color mode 0 is designed to support implementations in which the in-use drawing color is explicitly specified as a color value. This includes terminals without color maps as well as terminals with color maps that are implicitly defined, i.e., not directly addressable by the application process. In this mode, the SET COLOR command, described in the next section, directly sets the value of the in-use drawing color that is applied to subsequently received TEXT and graphics drawing commands. Color modes 1 and 2 are designed to support implementations that include a color map, that is, terminals whose in-use drawing color is specified as an ordinal number that is used as an address into a look-up table that provides the actual color value.

SET COLOR

The SET COLOR command is used to specify actual color values. The SET COLOR op codes takes a multi-value operand.

In color mode 0, this sets the in-use drawing color. This color remains in-use and is applied to subsequently received TEXT and graphics drawing commands until changed by either another SET COLOR command, the RESET command, or the US control character. The default drawing color in color mode 0 is white. A "background" color cannot be specified in color mode 0, that is, TEXT character PEL patterns and graphics drawing commands merely overwrite the existing contents of the display storage medium. Note that a given implementation may support any number of colors as long as it at least supports black and white. It is the responsibility of the terminal to choose the color that most closely approximates the specified drawing color if that particular drawing color is not available.

SELECT COLOR

The SELECT COLOR command is used to set the color mode as well as select the in-use drawing color for mode 1 and the in-use colors for mode 2. The SELECT COLOR op code can take zero, one, or two single-value operands. Any additional numeric data is ignored. If the SELECT COLOR op code is followed by no operands, color mode 0 is indicated. (On terminals with implicitly defined color maps, this will also reinitialize the internal color map.) The terminal will remain in color mode 0 until either another SELECT COLOR command with operands is received or the color mode is changed with a RESET command. While in color mode 0, the SET COLOR command is used to set the in-use drawing color, as described in the previous section, and the SELECT COLOR command is not used.

BLINK

The BLINK Command is used to control a blink process which operates on the color map entry indicated by the current in-use drawing color. (This is called the blink-from color.) This process periodically overwrites the contents of the blink-from color with a color value selected from the current contents of any other entry in the color map. (This is called the blink-to color.) After a specified on interval has expired, it then restores the color value that was over-written. After a specified off interval has expired, the process is repeated. Multiple blink processes can be specified simultaneously that may or may not share common blink-from or blink-to colors, and each can be specified to begin with a defined phase delay measured from the beginning of the next on interval of the most recently received active blinking process. These four parameters, the blink-to color, the on interval, the off interval, and the phase delay, are controlled by the operands of the BLINK op code. The BLINK op code takes a single-value operand, which may be one or more bytes long depending on the domain, followed by a three byte, fixed format operand.

CONTROL STATUS (WAIT)

The CONTROL STATUS (WAIT) command is used to indicate a programmed delay in the execution of the presentation code. The CONTROL STATUS (WAIT) op code takes two one-byte, fixed format operands.

RESET

The RESET command is used to selectively reinitialize the control and attribute parameters to their default values, clear the screen, set the border color, home the cursor, clear the DRCS set, texture attributes, macro-PDIs, PFKs, and unprotected fields. The RESET op code takes a two byte, fixed format operand. The order of execution of the resets is byte 1, low order bit (b1) to high order bit (b6), followed by byte 2, low order bit (b1) to high order bit.

Geometric Primitives

The six geometric primitives of the PDI set are used to create graphic images within the unit screen and with the attributes specified by the current values of the control parameters. Each is defined in four forms, and hence requires four op codes. The graphic primitives, POINT, LINE, ARC, RECTANGLE, POLYGON, are identical to the description in the CRC document and this will not be described herein. The primitive INCREMENTAL is the subject of our two concurrently filed copending patent applications, entitled, "Pictorial Information Processing Technique," and "Method and Apparatus for Providing a Video Display of Concatenated Lines and Filled Polygons," both of which are hereby incorporated by reference herein.

DRCS Downloading

The DEF DRCS command is used to initiate the downloading sequence for a single DRCS character. This is always followed, with a single exception that will be noted below, by the bit combination corresponding to the character position within the DRCS that is to be defined. For example, if the PEL pattern for the character in the first row, first column of the DRCS is to be defined a 2/0 would be sent. (Note that the DRCS G set does not need to be resident in the in-use table when the DRCS is defined, but only when it is called.) Any existing DRCS PEL pattern already associated with that character position is automatically deleted. The PEL pattern for the DRCS character can then be defined with any legal string of presentation code that follows, up to the receipt of the END command or any other command from the first five positions of the first column of the C1 set (FIG. 3), which terminate the downloading sequence. If the downloading sequence is terminated with another DEF DRCS command, thereby initiating another downloading sequence, then the DEF DRCS is not followed by the bit combination of the desired character to be defined, as it would be normally. Rather, this is implicitly taken as the next character in the DRCS G set, proceeding row by row, column by column cyclically through the set (i.e., 7/15 is followed by 2/0). For example, if a downloading sequence for character position 2/5 is terminated with the DEF DRCS character, then the next sequence will define the PEL pattern for character position 2/6.

The presentation code defining a DRCS character PEL pattern is executed at the time it is received within a unit coordinate system. The unit coordinate system, however, is not mapped to the display screen as it would be normally, but is mapped directly into a separate graphic repertory at address locations therein obtained from the sending source. This buffer, one of which must be maintained for every DRCS character currently defined, is 1 bit deep, and has a width (i.e., PELs horizontal), and height (i.e., PELs vertical) equal to the width and height of the area of the display screen that lies within the current character field size. For example, if the current character field maps to a 6×10 matrix of PELs on the physical display, the storage buffer used for that DRCS character PEL pattern is 6 PELs wide by 10 PELs high by 1 bit deep. (Only a single bit per PEL is required because only a on-off PEL pattern is being stored. This pattern will ultimately be used, when the DRCS character is called, in a manner identical to the permanently stored ASCII pel patterns, with the current TEXT attributes.)

The DRCS character storage buffer is initially cleared, i.e., set to all 0s. The in-use drawing "color" utilized for the execution of the downloading sequence is logical 1, regardless of the value of the current in-use color. All presentation level codes, i.e., code extension sequences TEXT characters (including other currently defined DRCS characters), PDIs, and control codes will be executed during a DRCS downloading sequence. Note that although the PDI commands SELECT COLOR, SET COLOR, and BLINK will be executed should they be sent, perhaps changing the state of various attribute parameters, they will have no affect on the DRCS pel pattern being downloaded. Note, also, that while TEXT size can be respecified during a downloading sequence, it will not affect the size of the DRCS character buffer, once allocated. Once the downloading sequence is terminated, the terminal reverts to the normal procedure of mapping the unit screen to the display screen and the drawing point is set to (0,0).

Individual DRCS characters can be deleted (i.e., any associated buffer storage can be de-allocated) by following the DRCS name character that follows the DEF DRCS command with the END command. All of the DRCS characters can be deleted simultaneously using the RESET command. Note that should a RESET that clears the DRCS be received during a downloading sequence, it will clear the character pel pattern definition in progress, though the downloading process will continue.

The minimum amount of buffer space that must be allocated to storing DRCS pels patterns is not specified and will depend on the particular terminal implementation.

Detailed Description

Referring again to FIG. 2, it will be seen that processor 1 operates to accept the code coming from a sending source either via communication line 11, broadcast signal 12, or peripheral device interface 17 (all shown in FIG. 1.) The incoming code is decoded via a decoding process shown as 201. When the DRCS code is received, the system operates to decode the generalized drawing commands. These decoded drawing commands are then tailored to the terminal display screen 5 by a terminal graphic interpreter routine to be discussed, and instead of being immediately displayed on the screen as in prior systems, these decoded instructions are stored in a local data base, or graphic repertory 10. Once stored, the Dynamically Redefinable Character Set (DRCS) can be invoked into the in-use table (FIG. 4) at any time by the sending source. Thus, the receiving terminal can have its graphic capability expanded without in any manner requiring a physical change to the terminal or to the display and without the sending source knowing the exact display characteristics.

When a character of the DRCS is retrieved and presented to the display, the decoded instructions may be adjusted or scaled by a mapping routine which can change the size, orientation, color, background, etc. of the retrieved graphic. The manner in which the storing and retrieving is accomplished in a typical system will now be discussed in detail with respect to FIGS. 6 through 9.

Figure 6:
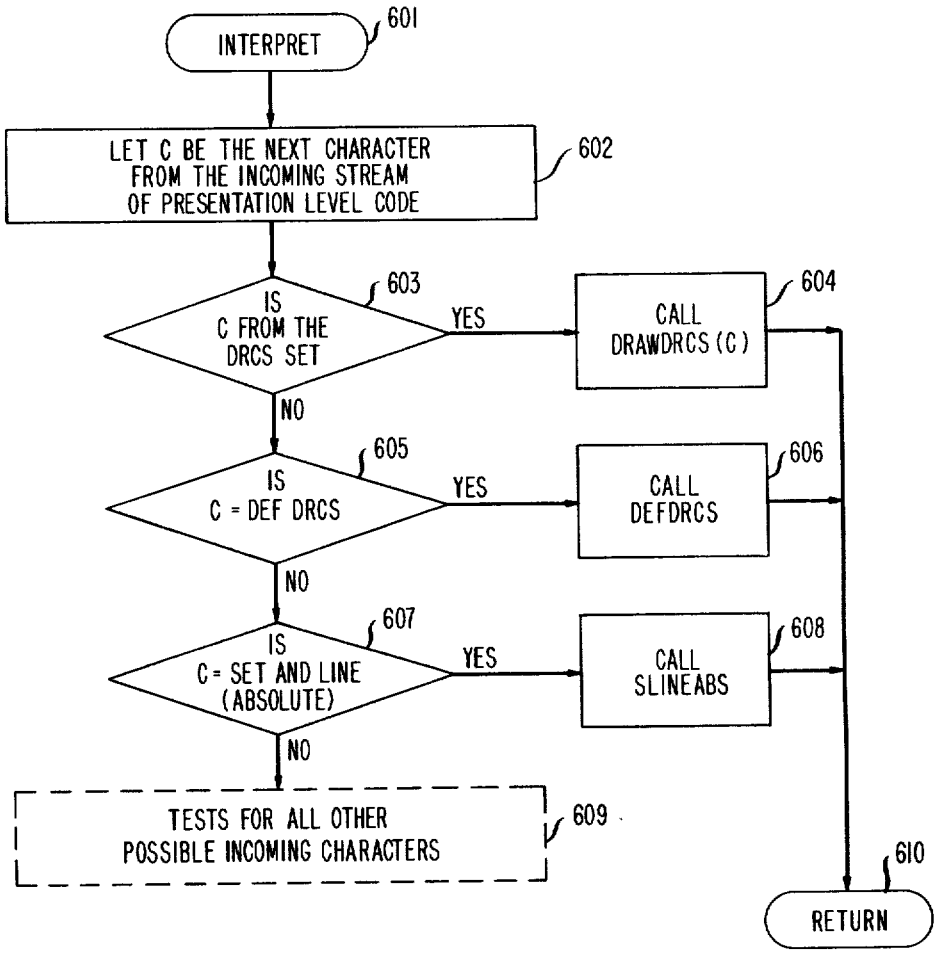
FIGS. 6 through 9 show flow charts of the algorithms used to control a data processor for our invention.

Turning now to FIG. 6, the INTERPRET process (601) obtains the next character from the incoming stream of presentation level code (602), and invokes the appropriate process to perform the function indicated by the character. If the character is any one of 96 from the DRCS G-set (603), the DRAWDRCS process is invoked with the character (C) as a parameter (604) to draw the character on the screen or into a buffer. When the DRAWDRCS process returns control to INTERPRET, the INTERPRET process returns control to the routine which called it (610). If the character is DEF DRCS from the C1 control set (605), the DEF DRCS process is invoked to define a downloaded character. When the DEF DRCS process returns control to INTERPRET, the INTERPRET process returns control to the routine which called in (610). If the character is from the PDI set, for example SET and LINE (ABSOLUTE) (607), the appropriate drawing routine is invoked to draw a geometric shape on the screen or into a buffer. In this case, SLINEABS process returns control to INTERPRET, the INTERPRET process again returns control to the routine which called it (610).

An actual INTERPRET process to interpret the entire presentation level protocol would continue on at (609) to test for each possible type of incoming character. In each case, INTERPRET obtains the next incoming character, invokes an appropriate process, and returns to its calling routine. The order of the tests for each type of character is not particularly important; neither is the fact that INTERPRET only processes one character at a time before returning.

Figure 7:
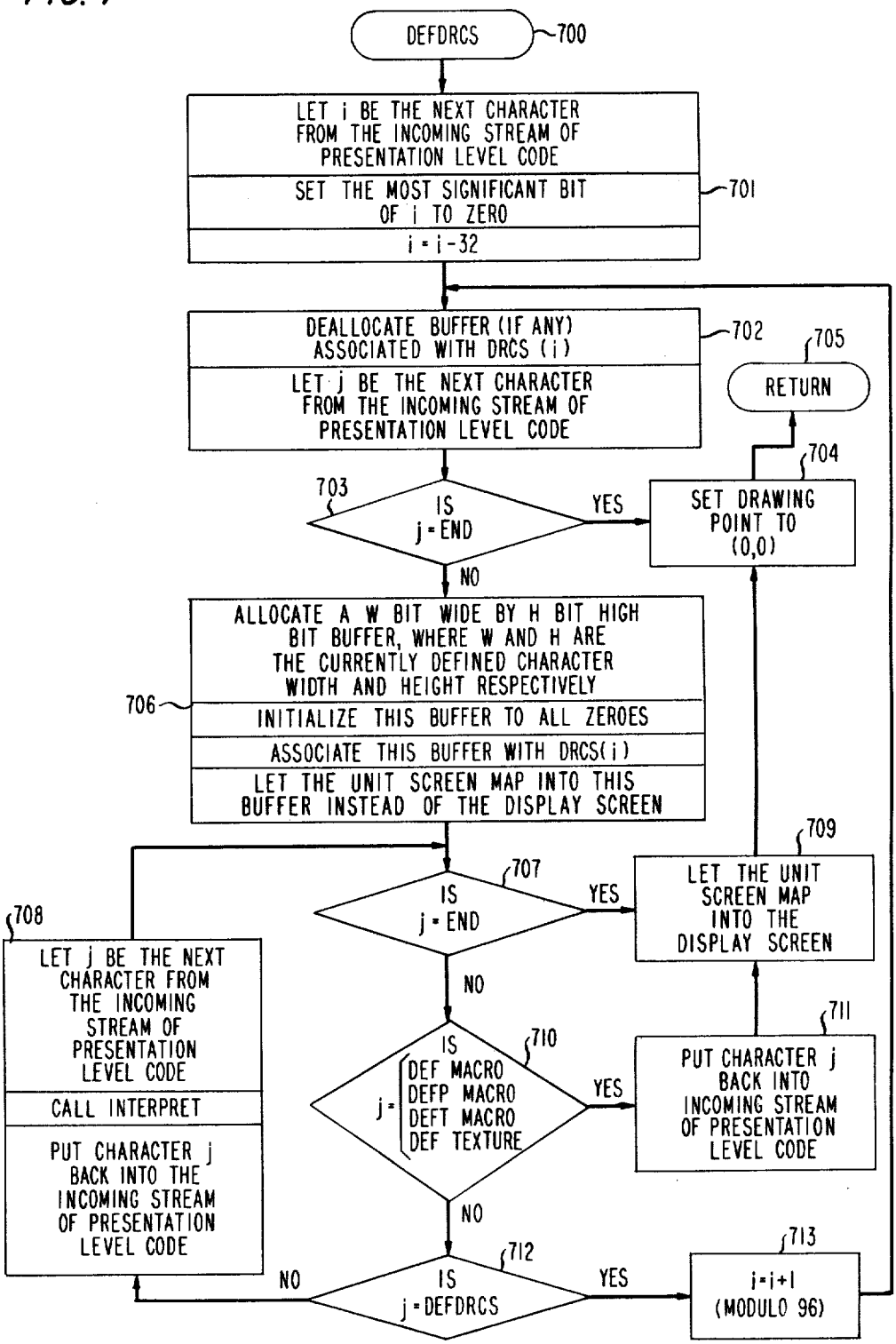

Continuing in FIG. 7, the DEF DRCS process (700) is invoked to create and save a bit pattern which defines a DRCS character, and also to undefine and free storage space for DRCS characters which are no longer needed. DEF DRCS obtains the next character from the incoming stream of presentation level code (701) and interprets this as the name of one of 96 possible DRCS characters. It ignores the most significant bit (by setting it to zero), and subtracts 32 to map it into the range of 0 to 95. The resulting number, i, is used as an index into an array of pointers to buffers containing images of DRCS characters (702). If a buffer already exists for character i, it is de-allocated. The next character from the incoming stream of presentation level code is then obtained. If this character is the END character from the C1 control set (703), the intent of the command was simply to undefine the DRCS character and free the storage space used by its buffer, which has already been done. The current drawing point is set to (Ø, Ø) (704), and DEF DRCS returns to its calling process (705). If the character was not END, the purpose of the command is to define a new DRCS pattern, so a new bit buffer is allocated corresponding to the character size currently in effect (706). This buffer in one embodiment is W bits wide by H bits high, where W and H are the number of PELs on the physical screen corresponding to the character width and height, dX, dY, respectively. Note that this character width and height must have been previously set using the TEXT command described priorly. Also note that the dimensions are interpreted in the coordinate system defined by the unit screen as it is normally mapped to the physical display screen. The buffer need only be a single bit deep, as only a simple on-off PEL pattern is used to define DRCS characters. The buffer is initialized to all zeroes and the array element DRCS (i) is made to point to it. The state of all drawing commands is now set to draw into this buffer rather than onto the physical display screen. Drawing commands will cause a 1 to be put into the bit buffer in each place a point is desired.

DEF DRCS now enters a loop to process all of the characters which will be used to define the DRCS character. Each character is first checked to see if it is the C1 control set END character (707). If it is, the DRCS definition is complete, so the drawing commands are made to once again draw out the physical display screen (709), the drawing point is reset to (Ø, Ø) (704), and DEF DRCS returns (705). If not, the character is checked to see if it is any of the other characters in the first 5 positions of the C1 control set. These characters are shown in box 710, FIG. 7. If it is, the character is returned to the incoming stream of presentation level code (711) where it may be retrieved by the INTERPRET process at a later time. Any of these characters also signal the end of the current DRCS character definition, so DEF DRCS terminates as before through (709), (704), and (705). The last special check on the character is to determine if it is the DEF DRCS character again (712). If it is, it signals the end of the current DRCS character definition and the beginning of a definition of the next sequential DRCS character. The index i is incremented modulo 96 (713) so that character zero follows character 95. Control then returns to the previous point (702) where the definition process begins.

If the character fails all of the comparisons, it is put back into the incoming stream of presentation level code (708), and INTERPRET is called to process it. This may cause something to be drawn into the DRCS bit buffer or some change in the state of the presentation level process. When INTERPRET returns, the next character from the incoming stream of presentation level code is obtained, and the previous loop is reentered to check for the characters which signal the end of the definition.

In this process, the details of the memory management of the bit buffers are not critical. A particular implementation may permanently assign buffer space to each of the 96 DRCS characters if it wishes. Also, the creation of the bit-buffer representation of the characters need not be done in real time. If the state of the presentation process is saved along with the sequence of defining characters, the bit-buffer representation may be created at any point up until the time it is first used. Lastly, the technique of passing parameters by putting them back onto the incoming stream is not required. Any equivalent scheme may be used.

Figure 8:
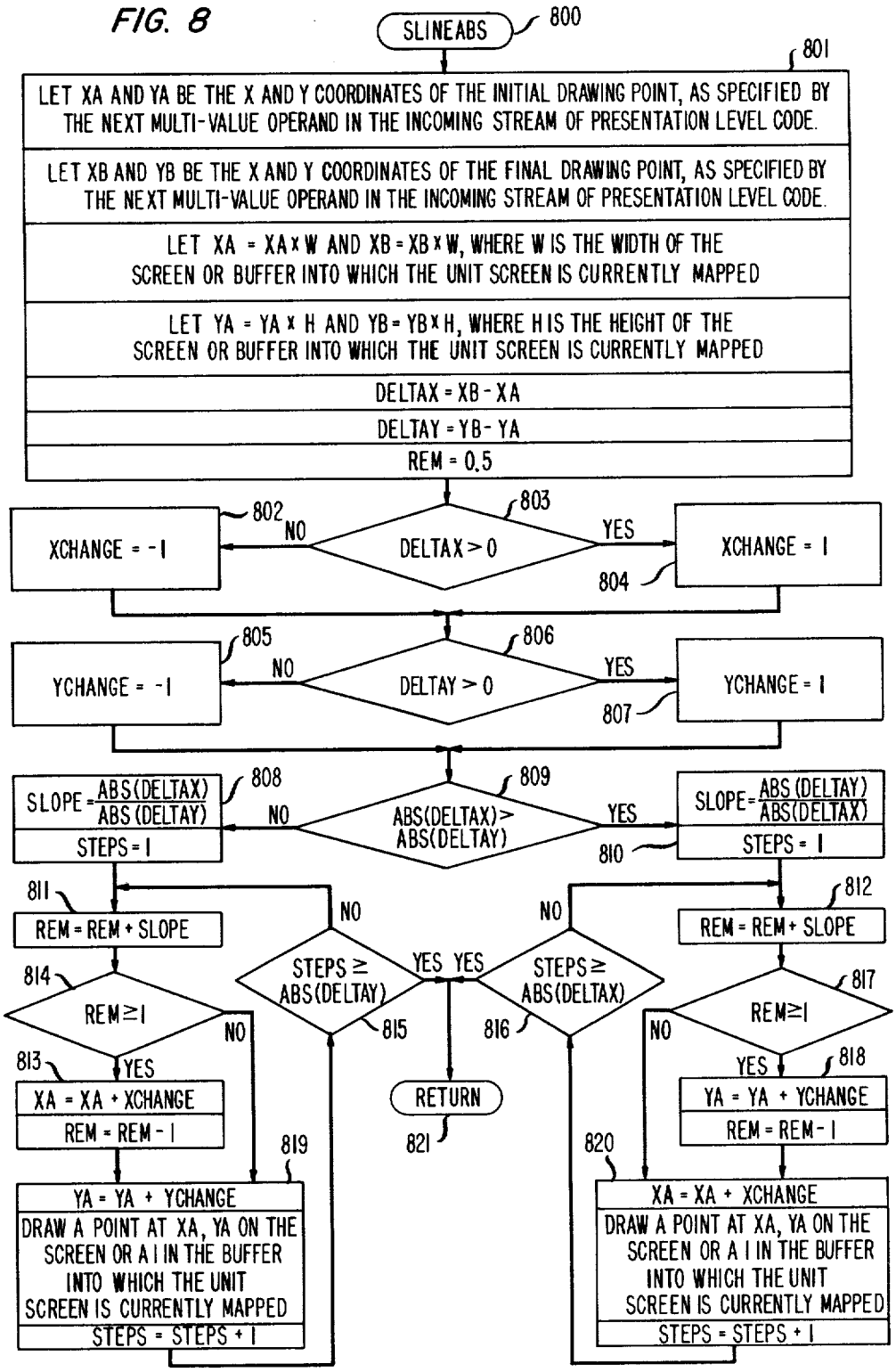
Figure 9:
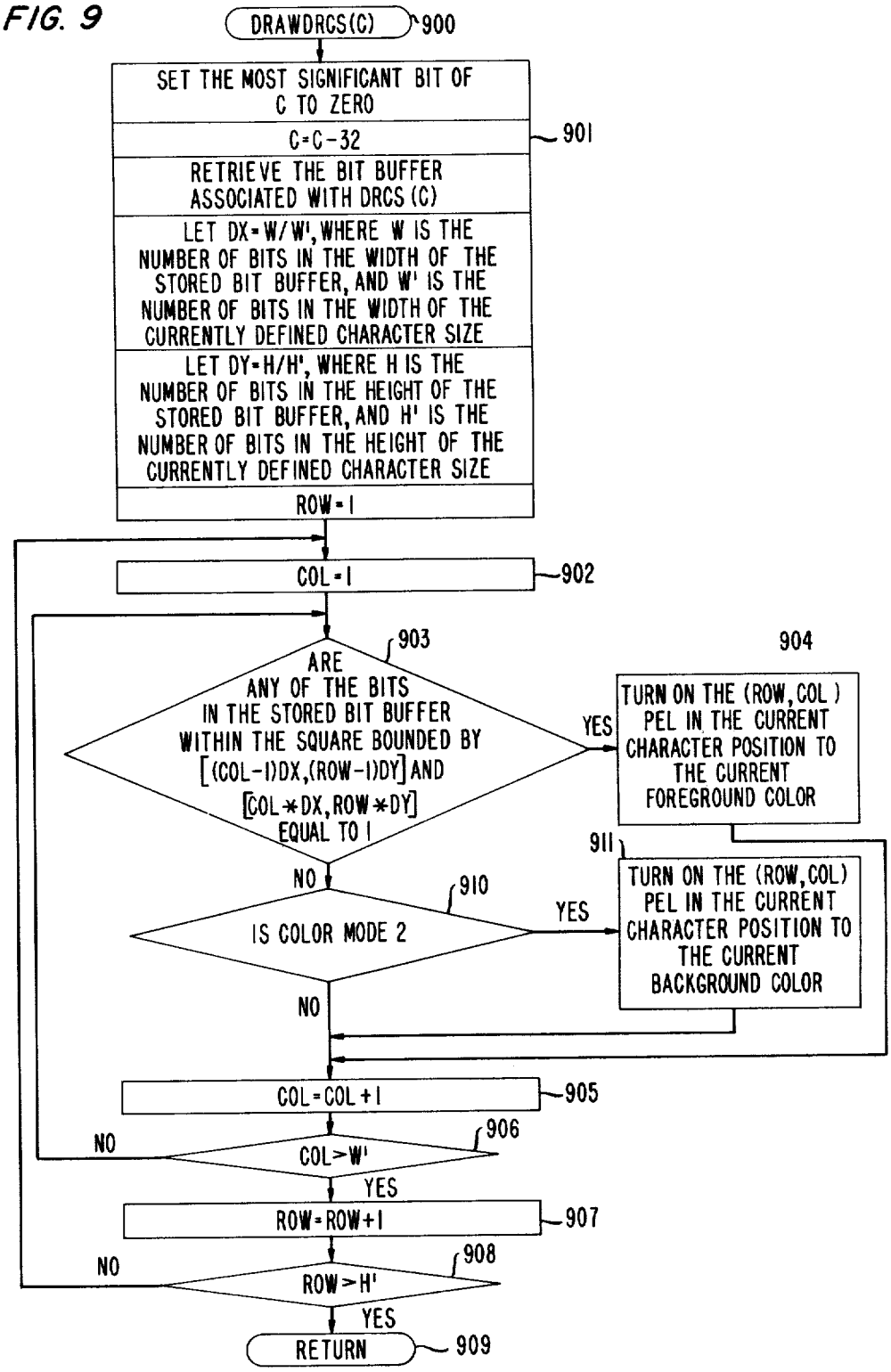

As shown in FIG. 8, the SLINEABS process (800) is invoked to draw a straight line between two points expressed in absolute unit screen coordinates. It will draw either on the physical display screen or into a bit buffer, depending on the state of the presentation process. During the definition of a DRCS character, it "draws" with 1's into the bit buffer assigned to that character. SLINEABS first obtains the coordinates of the endpoints of the line from the incoming stream of presentation level code (801). The number of characters corresponding to each multi-value operand is determined by the current state of the presentation level process. The first multi-value operand contains XA and YA, the X and Y coordinates of the starting point of the lines. The second multi-value operand contains XB and YB, the X and Y coordinates of the end point of the line. Both XA and XB are in unit screen coordinates, and are multiplied by W, the number of PELs or bits in the width of the screen or buffer (whichever is currently being drawn into) to obtain the X coordinates of the start and end PEL or bit of the lines. Similarly, YA and YB are multiplied by H, the number of PELs or bits in the height of the screen or buffer, to obtain the Y coordinates of the start and end PEL or bit of the lines. Once these coordinates have been transformed, the rest of the procedure exactly follows the DDA algorithm as shown in Principles of Interactive Computer Graphics, W. M. Newman and R. F. Sproull, McGraw-Hill, first edition, page 44. This is only one of many algorithms for drawing straight lines on a raster device. The presentation level protocol does not specify which must be used.

DELTAX, the number of PELs or bits between the X-coordinates of the endpoints of the line, is initialized to XB–XA. DELTAY, the number of PELs or bits between the Y-coordinates of the endpoints of the line, is initialized to YB–YA. REM, a fractional remainder to be used in subsequent calculations, is initialized to Ø.5. If DELTAX is greater than zero (803), XCHANGE (a unit step in the X direction) is set to one (804). Otherwise, XCHANGE is set to negative one (802). Similarly, if DELTAY is greater than zero (806), YCHANGE (a unit step in the Y direction) is set to one (807). Otherwise, YCHANGE is set to negative one (805). The remaining steps of the algorithm are exactly symmetrical with respect to the X and Y axes, so only one case will be described. First, the direction of greatest change is determined, by comparing the absolute values of DELTAX and DELTAY (809). If DELTAX is greater, the SLOPE is set to the quotient of the absolute values of DELTAY and DELTAX and a STEPS counter is initialized to one (810). Next, the value of REM is increased by an amount equal to the SLOPE (812). If REM is now greater than or equal to one (817), it is time to take a step in the Y direction and draw a point. YA is changed by the positive or negative unit value of YCHANGE, and a point is drawn at the coordinates (XA, YA), or a one is entered in the bit buffer at that point (820). STEPS is incremented by one, and is compared to the absolute value of TELTAX (816). If STEPS is less, the procedure is repeated at the point where REM is increased by an amount equal to the slope (812). Otherwise, the line is completed and SLINEABS returns (821) to the procedure which called it.

Turning now to FIG. 10, the DRAW DRCS process (900) is used to draw DRCS characters, which have already been defined, onto the display screen or into another buffer. The character which is passed to this routine (C) first has its most significant bit set to zero, and then 32 is subtracted from it (901). The resulting number is used as an index into the DRCS array to obtain the bit buffer containing the PEL pattern of DRCS character C. This pattern must be mapped into a character cell of the current size, regardless of whether this is the same size by which the character was originally defined. In order to determine which stored bits to map into each PEL on the display (or into each bit of the new buffer), two dimensions are computed. DX is set equal to the ratio of W, the number of bits in the width of the stored bit buffer, to W'; the number of PELs corresponding to the width of the character size currently in effect (or the number of bits in the width of the new bit buffer). Likewise, DY is set equal to the ratio of H, the number of bits in the height of the stored bit buffer, to H', the number of PELs corresponding to the height of the character size currently in effect (or the number of bits in the height of the new bit buffer). Two counters are initialized to a value of one, ROW and COL (902). A loop is entered to test each PEL (or bit) in the character cell on the screen (or in the new buffer) to see whether it should be turned on. If any part of any 1 bit in the stored DRCS character definition buffer is within a square bounded by the diagonal vertices [(COL−1)DX, (ROW−1)DY] and [COL×DX, ROW×DY], where (0,0) is the coordinate of the lower left bit of the buffer (903), the PEL with coordinates (ROW, COL) within the character cell on the screen is set to the current drawing color, or bit (ROW, COL) in the new bit buffer is set to 1 (904). Next, the COL counter is incremented by one (905). If COL is not greater than the width of the character being drawn (906), the loop is repeated for the next PEL (or bit) in the row. If COL is greater than W', the ROW counter is incremented by one (907). If ROW is not greater than the height of the character being drawn (908), the loop is repeated for the next row with COL set back to one (902). In this manner, the algorithm goes column by column, row by row through each PEL (or bit) of the character being drawn and determines whether that PEL (or bit) should be turned on. When the row counter exceeds the height of the character, the drawing is done and the DRAW DRCS process returns to the process which called it (909).

This method for mapping stored bits onto the screen or into a buffer of a potentially different size is one of many possible algorithms. The presentation level protocol does not specify which must be used. The responsibility for choosing an algorithm appropriate to a given display device or application is left to the implementor.

Conclusion

While the invention claimed has been shown in a particular embodiment having several fonts of possible graphics, it is to be understood that the invention is equally applicable to situations where there is no priorly stored graphic patterns. It is, of course, also to be understood that the term "graphics" includes alphanumerics, mosaic patterns, symbols, words, as well as graphical elements, such as lines, circles, and polygons.

It should also be understood that our invention is not limited to situations where the graphics must be tailored to a display only to solve resolution problems, but may be used in other situations where tailoring is necessary, such as for example, where the output is a printer and where the specific bit patterns must control the printing mechanism. In such a system the use of our invention would allow for complete freedom for the end user to select the receiving mode best suited for the purpose while allowing the sender freedom to transmit code without regard to the display medium. It is important to remember also that the remote source may be a keyboard connected directly to the terminal, or connected via a transmission medium, or the source may be a local or remote computer or other sending device.

It is also to be understood that the claimed invention can be used with any definable character set where the display terminal interprets the received command and generates the actual picture element bit patterns. Thus, the actual algorithms shown can easily be changed to fit the desired system without in any manner departing from the spirit and scope of our invention.

What is claimed is:

1. A communication terminal including a system for mapping characters onto a display, said system comprising means for receiving from a sending source a generalized drawing instruction, in conjunction with a designated address, said generalized instruction specifying an image, characterized in that the system also includes means for translating each received generalized drawing instruction into a drawing instruction uniquely associated with said terminal display, each said unique drawing instruction operative, when presented to said display, for presenting to a viewer said image, and means for storing said translated unique drawing instruction at said designated address locations within a graphic repertory.

2. The invention set forth in claim 1 further comprising means responsive to subsequently received designated address locations from a sending source for presenting the unique drawing instruction stored at said location corresponding to said subsequently retrieved address.

3. The invention set forth in claim 2 wherein said translated unique drawing instruction is a PEL bit pattern.

4. The invention set forth in claim 1 wherein said translating means is independent from said sending source.

5. The invention set forth in claim 4 wherein said translating means and said presenting means each include a unit display mapping routine uniquely associated with said terminal.

6. The invention set forth in claim 5 wherein said translating means is viewer rearrangeable.

7. The invention set forth in claim 1 wherein said translating means includes means for retrieving from a graphic repertory priorly stored unique drawing instructions.

8. The invention set forth in claim 1 wherein said presenting means includes scaling means operative in response to received instructions from a sending source for scaling said character prior to presentation to said display.

9. A communication terminal, an information channel for receiving code from a remote source, a display, means for receiving both a generalized drawing instruction descriptive of images to be presented on said display and a specific storage address for each said received instruction, means for generating from said received generalized drawing instruction bit patterns corresponding to said images, a memory, means for storing each said generated bit pattern in said memory at said specific storage addresses therein corresponding to said received address, means operative in response to code received over said information channel specifying the address at a particular bit pattern for retrieving said bit pattern from said memory, and means for mapping said retrieved bit pattern to said display.

10. The invention set forth in claim 9 wherein said mapping means is responsive to said received code for adjusting said retrieved bit pattern.

11. A communication terminal including an arrangement for mapping characters onto a display, said arrangement comprising means for receving from a sending source a drawing instruction, said instruction containing a description of a character, means for translating, under control of a stored graphic interpreter, each received drawing instruction into individual bit patterns each uniquely associated with said display of said terminal, each said bit pattern operative, when presented to said display, for presenting to a viewer an image of said associated character, means controlled by an instruction received from said sending source for preventing the presentation of said translated bit patterns to said display and for storing said translated bit patterns at designated addresses within a graphics repertory, and means responsive to received designated repertory address locations from a sending source for presenting to said display the bit pattern stored at said designated address locations.

12. The invention set forth in claim 11 wherein said presenting means is responsive to received instructions for adjusting said presented bit patterns.

13. The method of mapping characters onto a display, said method comprising the steps of receiving from a sending source a universal drawing instruction containing a description of a character and also containing a memory storage location therefore, translating each received drawing instruction into drawing instructions uniquely associated with said display, each said unique drawing instruction operative, when presented to said display, for presenting to a viewer an image of said associated character, and storing each said unique drawing instruction at said storage location within a memory.

14. The invention set forth in claim 13 further comprising the step of presenting, in response to a received address locations from a sending source, the drawing instruction stored at said address.

15. The invention set forth in claim 14 wherein said translating means is user rearrangeable.

16. The invention set forth in claim 14 wherein said presenting step includes the step of adjusting said unique drawing instruction in accordance with instructions received from a sending source.

17. The invention set forth in clam 14 wherein said translated unique drawing instructions comprise a set of bits having a correspondence with the display PELs.

* * * * *